US005996414A

United States Patent [19]

Mercado

[11] Patent Number: 5,996,414

[45] **Date of Patent: *Dec. 7, 1999**

[54] METHOD OF DETERMINING THE LENGTH OF A PILE

[75] Inventor: Edward J. Mercado, Houston, Tex.

[73] Assignee: North American Geotechnical Company, Seabrook, Tex.

[ * ] Notice: This patent is subject to a terminal disclaimer.

[21] Appl. No.: 08/925,808

[22] Filed: Sep. 9, 1997

[51] Int. Cl.[6] ..... G01M 7/00; G01N 3/30

[52] U.S. Cl. ..... 73/594; 73/597; 73/628

[58] Field of Search ..... 73/594, 584, 597, 73/628, 629, 641, 84

[56] References Cited

U.S. PATENT DOCUMENTS

| | | | |
|---|---|---|---|
| 3,641,811 | 2/1972 | Gnaedinger, Jr. et al. | 73/594 |
| 3,946,598 | 3/1976 | Towne et al. | 73/594 |
| 4,164,149 | 8/1979 | Okubo | 73/594 |
| 5,444,670 | 8/1995 | Douglas | 73/594 |
| 5,753,818 | 5/1998 | Mercado | 73/594 |

OTHER PUBLICATIONS

Ebrom er at., Imaging Shear–Wave diffractions from Pier Formations, *Society of Exploration Geophysics Convention,* p. 608, 1994.

*Primary Examiner*—Hezron Williams
*Assistant Examiner*—Helen C. Kwok
*Attorney, Agent, or Firm*—Harrison & Egbert

[57] ABSTRACT

A method for determining a length of a pile which includes the steps of affixing a plurality of sound sensors in a vertical array adjacent to the pile, generating an elastic wave adjacent the pile such that the elastic wave propagates through or from the pile, radiating the elastic wave from the pile such that the sound sensors receive the radiated elastic wave, and analyzing the radiated elastic wave so as to determine the length of the pile. The elastic wave can be radiated so as to create upwardly propagating waves and downwardly propagating waves within the pile. The radiated elastic waves can also produce refracted elastic waves along a length of the pile and diffracted elastic waves at a bottom of the pile. The data from the radiated elastic waves is analyzed so as to be determinative of the length of the pile.

20 Claims, 9 Drawing Sheets

METHOD OF DETERMINING THE LENGTH OF A PILE

TECHNICAL FIELD

The present invention relates to methods for determining the length of a pile used for construction. More particularly, the present invention relates to elastic wave methods for determining the length of a pile. Furthermore, the present invention relates to elastic wave methods in which elastic waves radiating from the pile are analyzed and correlated to the length of the pile.

BACKGROUND ART

In recent years, it has become increasingly necessary to rehabilitate the superstructures of highway bridges. In order to properly rehabilitate the superstructures of various constructions, decisions must be made concerning the adequacy of the existing foundations. This is particularly true for older structures for which as-built records are missing and for which foundation deterioration may have occurred. Visual inspection of foundations is virtually impossible. As such, a need has developed so as to provide procedures for evaluating the capacity of existing foundations. In particular, a need has developed to provide a procedure for determining the length of a pile in such foundations. A "pile" is defined as a member with a small cross-sectional area (in comparison with its length) used to provide adequate support for a column or wall resting on soil which is too weak or too compressible to support the structure with a spread footer. As used herein, the term "bent" includes piers or other structures above the foundation.

There is a serious need to rehabilitate the aging highway system. Within the United States, over 35% of the 575,410 bridges in the 1992 National Bridge Inventory were classified as needing to be replaced or rehabilitated. It has been estimated that over the next 20 years approximately $165 billion must be invested to address the tremendous rehabilitation backlog and to improve accruing bridge deficiencies. The economic value of the foundations for many bridges can be up to 25% of the cost of the bridge. This makes foundations a major economic component in the rehabilitation/repair effort. Inadequate foundations can, of course, jeopardize the entire superstructure of any rehabilitated bridges.

Bridge safety issues are foremost among the considerations for rehabilitation. Foundation failures, or excessive foundation movements, mostly from the application of extreme event loads, have occurred too frequently in recent years, exposing the public to risks that can be reduced by evaluation of the adequacy of existing foundations. Examples of major fatal catastrophes are the Sunshine Skyway Bridge in Florida (35 deaths), the Schoharie Creek Bridge in New York (15 deaths), the collapse of the Nimitz Freeway viaduct during the Loma Prieta earthquake (67 deaths), and a barge impact of a bridge in New Orleans (1 death). Clearly, upgrading of structures without appropriate knowledge of the adequacy of the foundations increases this vulnerability.

The traditional approach for evaluating such structures is to examine the as-built records. The as-built records include information on number, depth and width of the foundation elements, the soil characteristics at the bridge site and the recorded observations of the inspector during construction (concerning the potential for structural defects in the foundations). If necessary, as-built conditions can be confirmed by probing the exterior of the foundation and/or coring concrete piles or drilled shafts, if appropriate equipment can be positioned for the task. Once the loads for the rehabilitated structure are known, the capacity of these foundations can be evaluated in light of modern geotechnic design methods and the adequacy of the foundation determined. In the event that serious difficulties were noted during the installation of one or more foundation elements, or if probes and cores reveal defects, judgment must be exercised whether to exclude the questionable foundation element from consideration as a load-bearing pile or shaft. On occasions where the superstructure load can be taken off the foundation during the rehabilitation process, representative piles or shafts can be subjected to load tests, which is the most definitive way to evaluate the adequacy of the foundation. New geometrically identical "sister" piles or shafts can be installed immediately adjacent to the foundation of interest and subjected to load tests.

If as-built records are not available, or if they are incomplete, the traditional approach is not always appropriate because destructive probing and coring necessary to completely identify the foundation must be very extensive. In this case, nondestructive testing methods can be employed. Appropriate types of nondestructive tests for this purpose include pulse-echo and impulse-response testing, steady-state vibration testing, ambient vibration surveys, and shear-wave seismic reflection profiling. Various other techniques, such as casting sensors, or access tubes for sensors, into the pile or shaft, are not practical for evaluating existing foundations.

The pulse-echo and impulse-responsive testing involves the application of low-amplitude, impulse-type elastic waves directly to the head of an element of the foundation (pile or drilled shaft) with measurement of the reflected compression waves (P-waves) or shear waves (S-waves) from the bottom of the element or from a significant defect within the element, if such a defect exists. The input signal (load time history from an impulse source, for example a hammer, that creates the elastic wave in the foundation) can be measured along with the reflected signal (velocity or acceleration time history on the element near its top), or only the strain time history signal at the head of the pile may be measured, and the data processed in several ways. If a time history graph of the strain signal is displayed, peaks in the signal of a sensor on the element at known times can sometimes be interpreted as representing points of reflection if the compression or shear wave velocity of the pile material can be estimated. This so-called "pulse-echo" method has been applied mostly to piles and drilled shafts that are directly accessible (so that instruments can be attached directly to the pile or shaft and not to a cap, bent, column, or abutment) and has been applied to the investigation of both structural integrity and as-built depths of foundations.

Impulse-response testing (sometimes referred to as transient response testing) can be used for the same purpose, although it is somewhat more complex. With this method, both the input (elastic impulse source) and output (sensor) signals are recorded and processed in the frequency domain by a computer to develop a "mobility" function, which varies with frequency. In an ideal foundation, the mobility-frequency diagram makes it much more straightforward to interpret depths to major defects or pile/shaft lengths where defects do not occur. However, the presence of multiple defects in the foundation, reverberations from the superstructure, and other factors make this method difficult to use in evaluating existing foundations.

A disadvantage of the pulse-echo and impulse-response (mobility function) tests are that they appear to require that the sensor be placed on the foundation element (pile or shaft) itself, which may be difficult in some bridge foundations.

A well-established method for the characterization of the dynamic behavior of a structure is the steady-state vibration test. The superstructure is excited by a mechanism that generates a steady sinusoidal force in time. After a short period of time, the structure settles into a periodic steady-state mode of response at the exciting frequency. The force generator can be a small electromagnetic device, a mechanical device with a pair of counter-rotating masses, or a large mass driven by a linear actuator. The structural response can be monitored by displacement, velocity or acceleration sensors. By exciting the structure at several frequencies, a frequency response curve is obtained for a given point on the structure, from which modal frequencies and damping ratios are derived. This method has been rather widely applied to buildings, bridges, nuclear power plant structures and dams. When applied to bridges, it is mainly used to study the vibration of the superstructure. This forced vibration method can conceivably be used to infer foundation performance at low strain levels, but it is not likely to be useful in this respect because the overall system response of the structure depends very little on the foundation contribution. That is, any foundation behavior is masked, perhaps totally, by the superstructure behavior and cannot be separated from the system response, as the entire superstructure-foundation system is responding to the single frequency of the exciting force.

An ambient vibration survey records the vibration of a structure caused by ambient forces, such as wind, microtremors, traffic or any other forms of excitation that tend to be random and sustained, but small in amplitude. This method is most useful for characterizing the overall behavior of the structure, and when applied to a bridge, it is again limited in terms of characterizing foundation response because the dominant response will be from the superstructure.

Another technique that has been utilized is a technique for imaging shear-wave diffractions from pile terminations. This technique was described in an article by Ebrom et al. as published in the Society of Exploration Geophysics Convention Abstracts, 1994. This method is used to determine the subsurface lengths of terminations for a shaft or pile. In this method, it is necessary to perform a shear-wave survey in the immediate proximity of the pier and to infer the depth from the two-way travel time. This survey is aimed at delineating a terminating vertical unit, such as the shaft or pile. The goal of this method is to enhance diffracted seismic waves from the base of the shaft or pile. These diffractions are created when the shear-wave seismic wave field encounters the abrupt termination of the shaft or pile. The diffraction event is proportional in amplitude to the incident wave and the shear modulus contrast between the soil and the shaft or pile. The diffractions from the terminus of the shaft or pile possessing large modulus contrasts are easily detectable. In a typical highway environment, the shear-wave modulus contrast between near-surface soils and concrete are quite large, generally far exceeding a factor of 10:1. In this method, a horizontal array of sound sensors is provided in an area surrounding the bent or pier. A horizontal or vertical hammer blow is applied to the bent or pier. The elastic wave sensors will receive the diffracted waves from the bottom of the shaft or pile so that calculations can be carried out as to the length of the shaft or pile. This method includes a Kirchhoff migration by summing together the amplitudes that lie along the diffraction hyperbola (as calculated from the velocity field of the medium), and placing the summed amplitudes at the apex of the hyperbola. The apex of the diffraction hyperbola corresponds geometrically to the position of the diffracting point. After migration, diffracting points are imaged as high-amplitude events. Unfortunately, this method is often difficult to apply in areas in which space is limited. If it is not possible to arrange a large horizontal array of sensors in a location adjacent to the bent or pier, then this method cannot be effectively used.

It is an object of the present invention to provide a method which effectively determines the length of a shaft or pile.

It is another object of the present invention to provide a method for determining the length of a shaft or pile which is non-destructive.

It is a further object of the present invention to provide a method for the determination of a shaft or pile which is easy to use, easy to implement, and relatively inexpensive.

It is a further object of the present invention to provide a method for the determination of the length of a shaft or pile which can be utilized in a relatively limited physical area.

These and other objects and advantages of the present invention will become apparent from a reading of the attached specification and appended claims.

SUMMARY OF THE INVENTION

The present invention is a method for determining a length of a pile that comprises the steps of: (1) affixing a plurality of elastic wave sensors in a vertical array adjacent to the pile; (2) generating an elastic wave adjacent the pile such that the elastic wave propagates through or from the pile; (3) radiating the elastic wave from the pile such that the plurality of elastic wave sensors receive the radiated elastic wave; and (4) analyzing the radiated elastic wave so as to determine the length of the pile.

One embodiment of the present invention is identified as a transient forced vibration survey. In this method, the step of affixing includes affixing the plurality of elastic wave sensors directly to a surface of a structure connected to and above the pile. In particular, the structure can be a bent column and a bent cap located at the above ground portion of the bent. Each of the elastic wave sensors is a geophone which is spaced equally from an adjacent geophone. The step of generating elastic waves includes striking the surface of the structure on a side or top so as to generate elastic waves that radiate through the interior of the structure. The radiated elastic wave creates upwardly propagating waves and downwardly propagating waves within the pier. In this method, the step of analyzing includes autocorrelating the data from the upwardly propogating waves and the downwardly propagating waves so as to produce a peak corresponding to a periodicity relating to a length of the pile. This method can further include the step of separating the upwardly propagating waves from the downwardly propagating waves, and then autocorrelating the upwardly propagating waves and the downwardly propagating waves so as to produce a peak corresponding to a periodicity related to a length of the pile. The upwardly propagating waves, in this alternative method, are filtered from the downwardly propagating waves. The step of autocorrelating uses graphical peaks which correspond to a periodicity related to the length of the structure and a peak corresponding to a periodicity relating to a length of the pile.

An alternative form of the present invention is identified as a parallel seismic survey. In this alternative form of the present invention, the step of affixing the sound sensors includes forming a vertical hole adjacent to and in generally parallel relationship to the pile, and placing a vertical array of the elastic wave sensors in the hole. The vertical hole has a length greater than a length of the pile. The vertical array has an elastic wave sensor extending so as to be lower than an expected bottom of the pile. The step of generating an elastic wave includes creating an impulse on or adjacent to a top of the pier so that the elastic wave propagates through the pier and pile as a refracted wave. The step of reflecting includes refracting the elastic wave through a length of the pile and diffracting the elastic wave at a bottom of the pile. In this method, the step of analyzing includes determining a point along the vertical array in which the refracted wave changes to the diffracted wave and correlating the point along the length of the array so as to be related to the length of the pile. The step of determining also includes migrating the data. A simple method of migrating the data includes the steps of: (1) picking a first arrival time of the elastic wave to the point; and (2) plotting a circle of radius calculated from a velocity of propagation of the elastic wave through the soil between the vertical hole and the pile and a departure of the arrival time from a linear extrapolation of refraction arrival times so as to establish a diffraction center. In this alternative embodiment of the present invention, it is preferable that each of the plurality of sensors be a hydrophone. At least a portion of the vertical hole is filled with liquid, preferably water. Alternatively, it is possible to clamp geophones directly to the casing of the hole.

DETAILED DESCRIPTION OF THE INVENTION

The present invention contemplates the use of a transient forced vibration survey and a parallel seismic survey for the determination of the length of a pile. In either of these methods, the steps of the present invention include the steps of affixing a plurality of sound sensors in a vertical array adjacent to the pile so as to be responsive to elastic wave radiation passing from the pile. The elastic wave is generated adjacent to the pile such that the elastic wave propagates through or from the pile. The elastic wave sensors receive the radiated elastic wave from the pile. Finally, the radiated elastic wave is analyzed so as to determine a length of the pile. In contrast to the prior art, the present invention, in either of its embodiments, contemplates a method in which the area utilized for the elastic wave sensors is relatively small. In the first embodiment of the present invention, the transient forced vibration survey, the elastic wave sensors are directly connected to the bent structure located above the foundation. In the alternative embodiment of the present invention, in the parallel seismic survey, the vertical array of elastic wave sensors is positioned in a vertical hole adjacent to the pile. In either of the embodiments of the present invention, the term "pile" refers to pilings, shafts, foundation structures, and related structures that extend vertically into the earth a distance from the earth so as to support a structure above the earth. Also, as used herein, in either of the embodiments, the phrase "affixing the sound sensors in a vertical array" means either placing the sound sensors directly onto a structure (such as a bent column and bent cap located at the above ground portion of the bent) or in a vertical array spaced from the pile. The term "elastic waves" can mean compression waves (P-waves), shear waves (S-waves), Raleigh waves, Stoneley waves, reflections, refractions, diffractions, head waves, acoustic waves, and the like.

Transient Forced Vibration Survey

Figure 1:
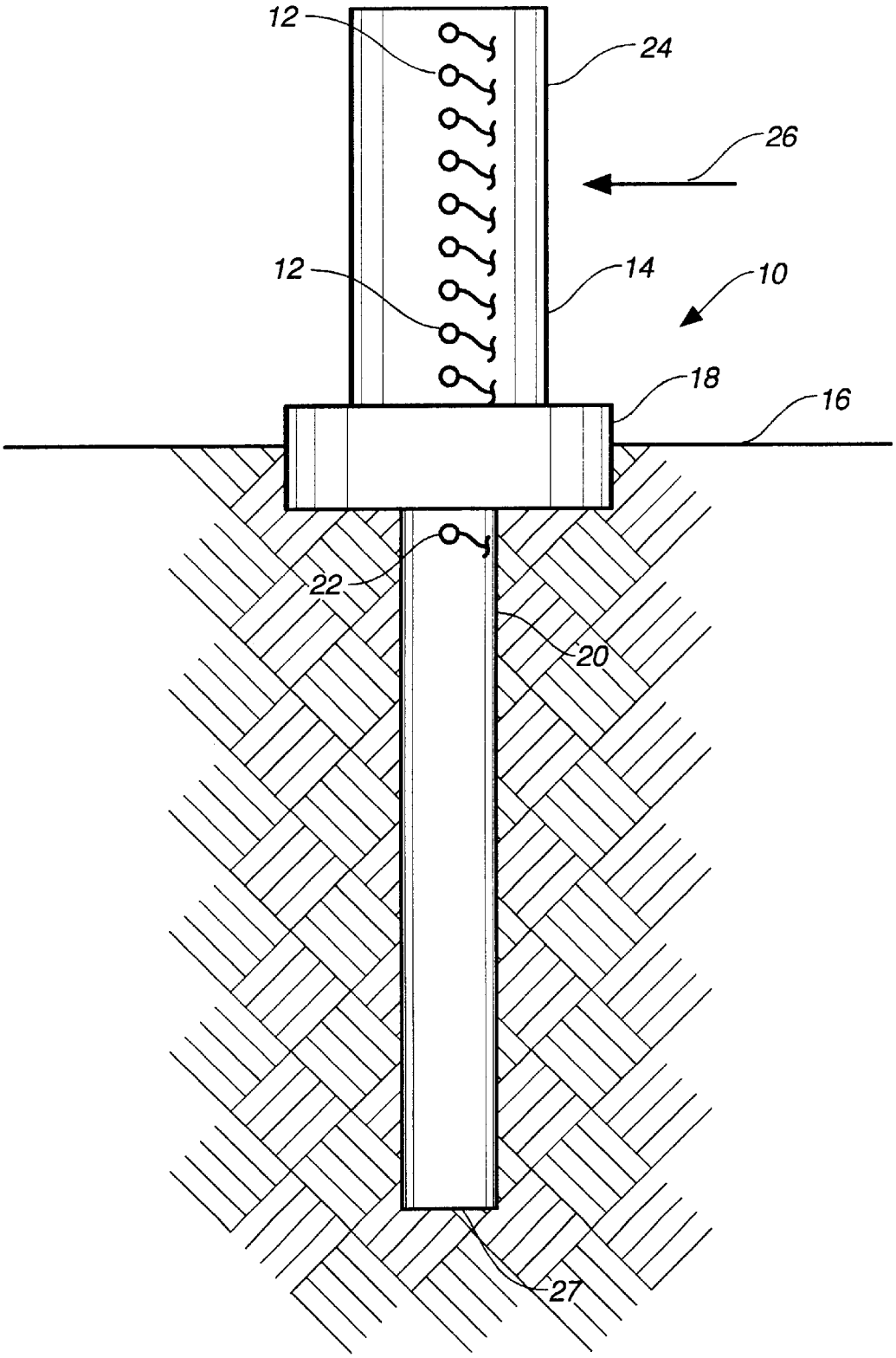
FIG. 1 is a diagrammatic illustration of the transient forced vibration survey method in accordance with the present invention.

Referring to FIG. 1, there is shown at 10 the structure for the carrying out of the transient forced vibration survey in accordance with the preferred embodiment of the present invention. As can be seen in FIG. 1, a plurality of geophones 12 are arranged in a vertical array on a surface of the bent 14. The bent 14 extends upwardly above the earth 16 from the pile cap 18. The pile 20 resides below the pile cap 18 and extends into the earth 16. The bent 14 is positioned directly above and is connected (by way of the pile cap 18 or by a construction joint) to the pile 20. In the preferred form of the present invention, an elastic wave sensor 22 is affixed to the pile 20 just below the pile cap 18. However, if, because of the nature of the construction it is impossible to attach the sound sensor 22 to the pile 20, then this step can be avoided.

In FIG. 1, it can be seen that an elastic wave is generated by creating an impulse, such as striking a hammer to the surface 24 of the bent 14 in the manner of arrow 26. The elastic wave sensors 12 are attached to the side of the bent 14 so as to be spaced approximately an equal distance from each other. As shown in FIG. 1, a total of nine sound sensors 12 are affixed to the bent 14 and spaced from each other at one foot intervals. The elastic wave sensors 12 can be geophones which effectively serve to receive radiating elastic waves. The geophones 12 serve to record the resulting elastic waves propagating within the bent 14.

Figure 2:
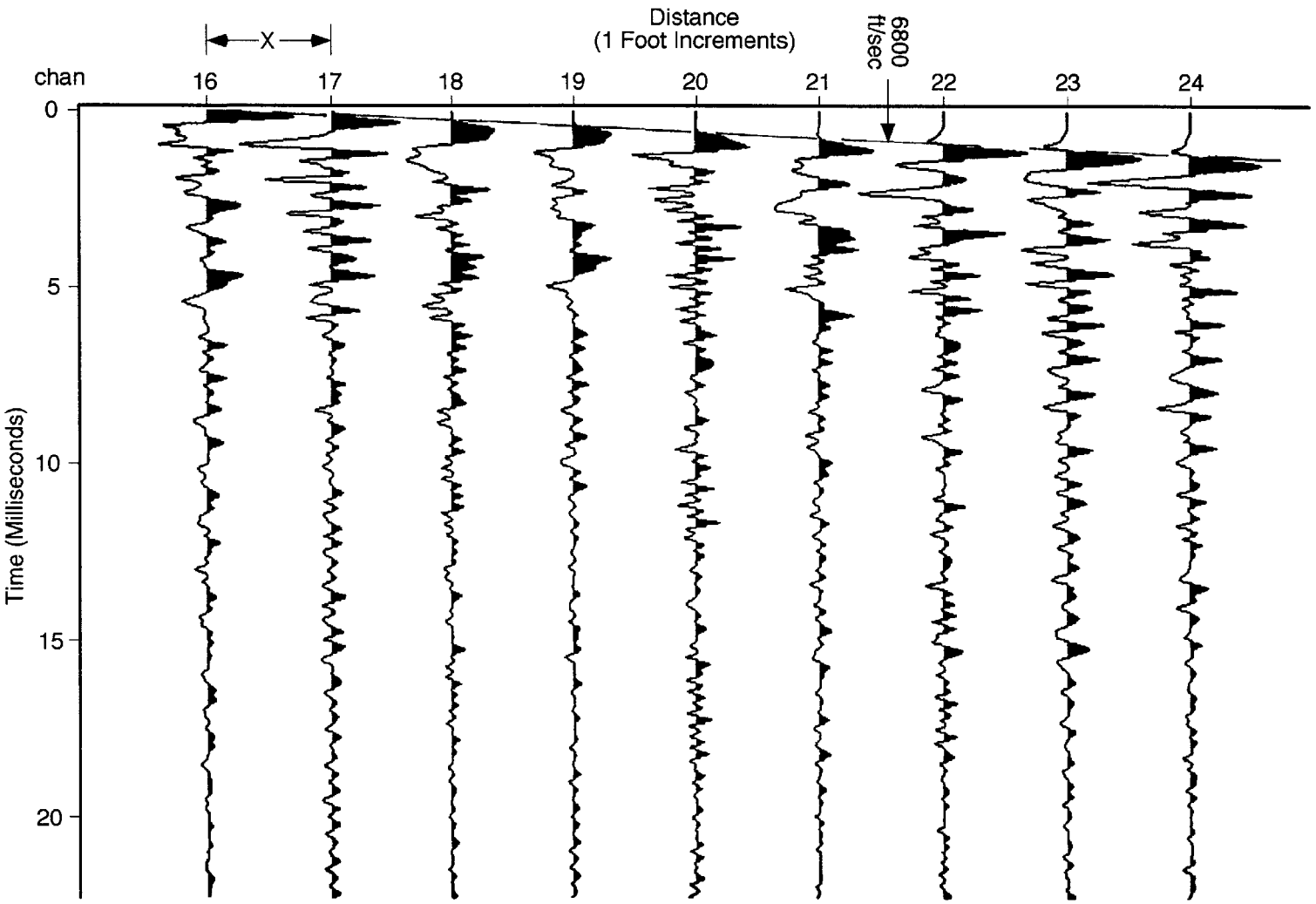
FIG. 2 is a graphical illustration of the expanded time scale of the velocity test on the bent with a measurement of first energy arrival times.

Through the use of the geophones 12, individual elastic waves can be recognized that initially propagate upwardly and reflect downwardly with reversed polarity from the top of the pier. The geophones 12 can also recognize events that initially propagate downwardly and reflect upwardly with reversed polarity from the bottom 27 of the pile 20. The individual energy arrival times $T_1$ and $T_2$ of these events vary systematically as the position of the receiving geophone 12 changes. This regular variation in arrival time makes it possible to measure the velocity in the bent 14 from the first energy arrivals. This measurement is illustrated, with particularity, in FIG. 2. FIG. 2 shows a blow-up of the early part of the seismic data so as to facilitate the measurement of the first energy arrivals accurately. In FIG. 2, the geophones are located at one foot intervals and the display time scale is in milliseconds. As can be seen in FIG. 2, the measurement of the first energy arrival yields a velocity of 6,800 feet per second. In measuring the first energy arrival times, it is necessary to take into consideration that the waves are dispersive, as shown by the changing phase of the first energy arrivals. As such, it is necessary to pick group velocity versus phase velocity. This dispersion effect is most pronounced in the early part of the wave propagation and becomes less noticeable as the propagation distance increases. Beyond the first energy arrivals, the recorded information is too complex to uniquely identify individual reflection events from the top, bottom, and internal reflecting interfaces.

The analysis by the method of the present invention is based upon the fact that all multiple reflected events pass the geophone array in one direction so as to maintain constant time periods $\Delta T_1$ and $\Delta T_2$, which are always twice the transit time of the path traversed between the effective reflection boundaries. Because the data is recorded through an array, it is possible to identify which direction any wave is passing the array, either upward or downward. The upward propagating waves can be separated from the downward propagating waves by appropriate velocity filtering of the array data. Since the time periods $\Delta T_1$ and $\Delta T_2$ are fixed by the geometry of the structure, multiple reflections within the structure will maintain these periodicities. The expected transit time paths for a shear wave reverberating within the joined structure is shown in the graphical illustration of FIG. 3.

Figure 3:
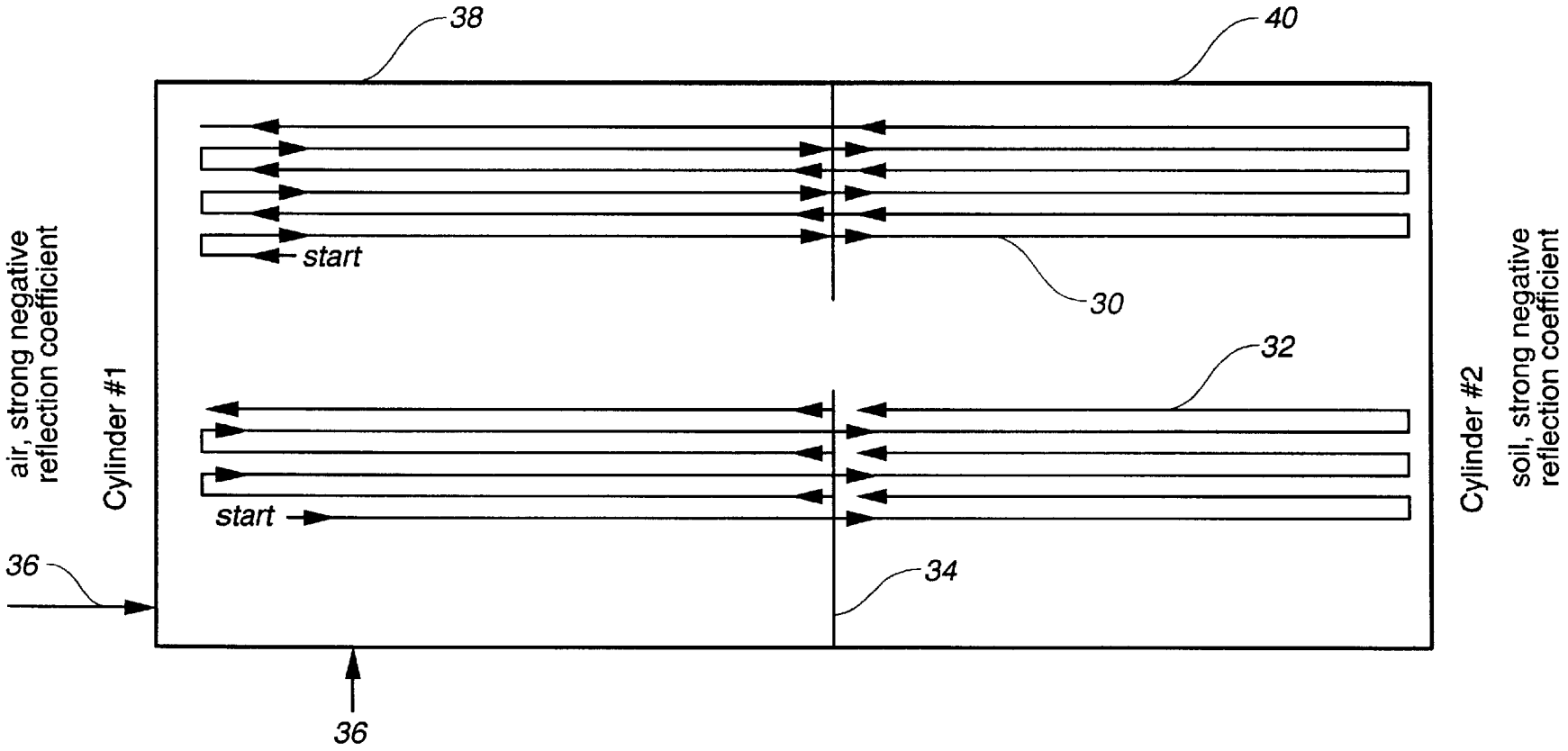
FIG. 3 is a diagrammatic illustration of the travel times of the upwardly propagating waves and the downwardly propagating waves.
Figure 4A:
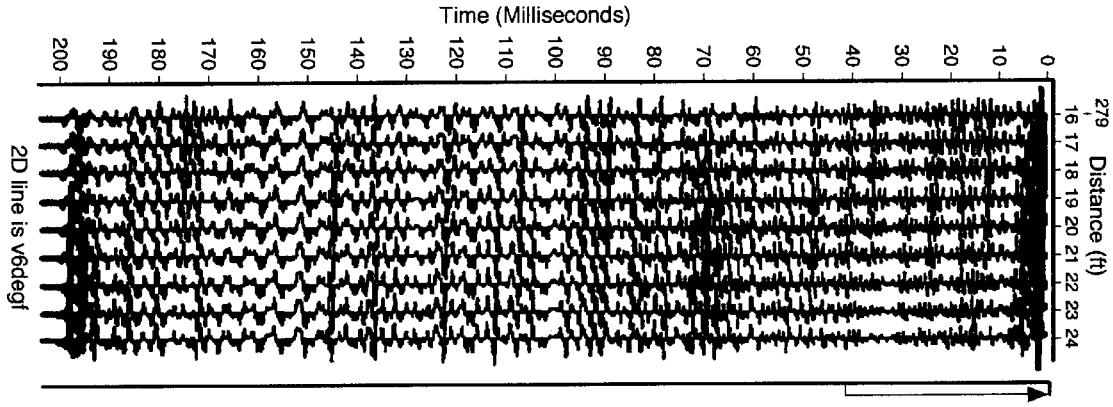
FIGS. 4A–4C are graphical illustrations of the upwardly propagating waves with outputs of 6, 10 and 14 degree velocity filters.
Figure 4B:
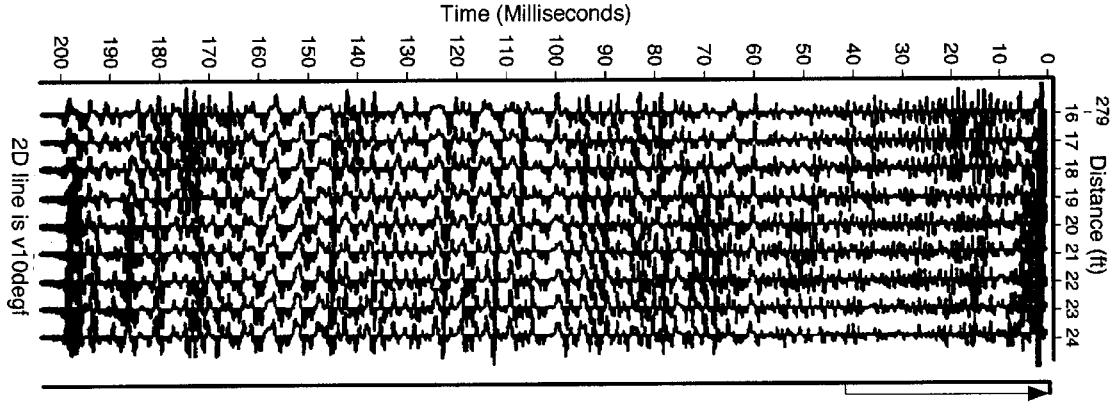
Figure 4C:
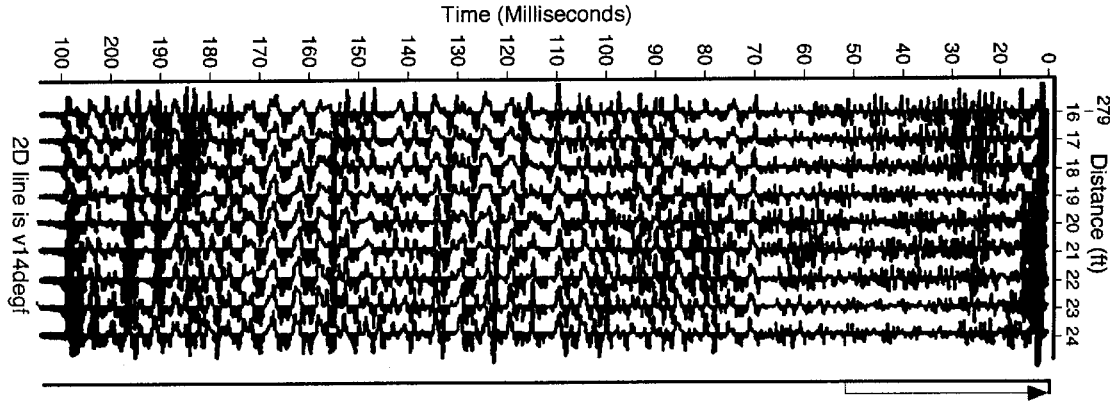

FIG. 3 shows the paths 30 for initially upward travelling waves and the paths 32 for initially downwardly travelling waves. The interior interface is shown by vertical line 34. Arrow 36 shows the location of the elastic wave energy source. The elastic wave energy source can be located either on the top or the side of the cylinder. The waves 30 and 32 show each of the wave fronts as hitting the interior interface 34 between cylinder 38 and cylinder 40. Cylinder 38 will correspond to the bent column 14 and the pile cap 18. Cylinder 40 will correspond to the pile 20. The wave fronts propagating within the cylinders 38 and 40 are partially reflected and partially transmitted at the interfaces at each end of the cylinders. Each partial transmission to the lower cylinder 40 is in turn partially transmitted and reflected at the interior interface 34. This creates a complex pattern of interrelated events that are detected by the geophones 12. The only commonality is that the periods between the chains of events are constant and determined by the transit time in each cylinder. The autocorrelation function of the geophone recordings will show their inherent periodicity.

As an example utilizing the present invention, when one examines the structure of the individual bent column 14 being tested, the structure will appear as two joined columns 38 and 40. Column 38 extends from the construction joint joining the column 14 to the pile 20 to the free air surface at the top of the bent cap. The column 40 relates to the drilled shaft. In an experiment with the present invention, these dimensions, as shown from the as-built plans, where, respectively, 14.25 feet and 45 feet. In this embodiment, $\Delta T_1$ is the round-trip transit time in the upper cylinder 38 and $\Delta T_2$ is the round-trip time in the lower cylinder 40.

Figure 5A:
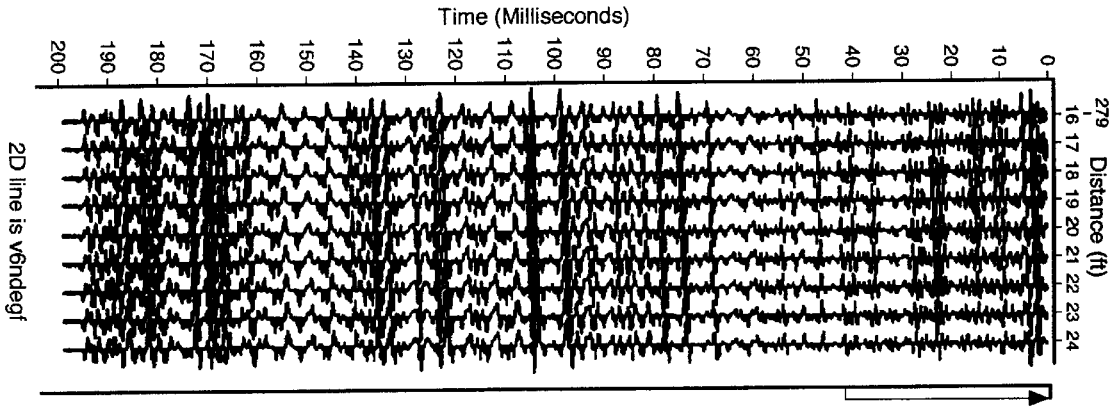
FIGS. 5A–5C are graphical illustrations of the downward propagating waves with outputs of 6, 10 and 14 degree velocity filters.
Figure 5B:
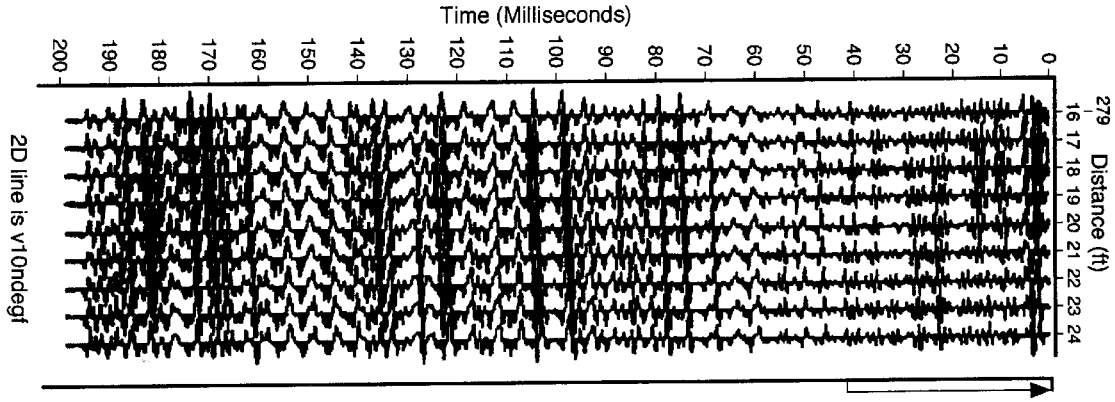
Figure 5C:
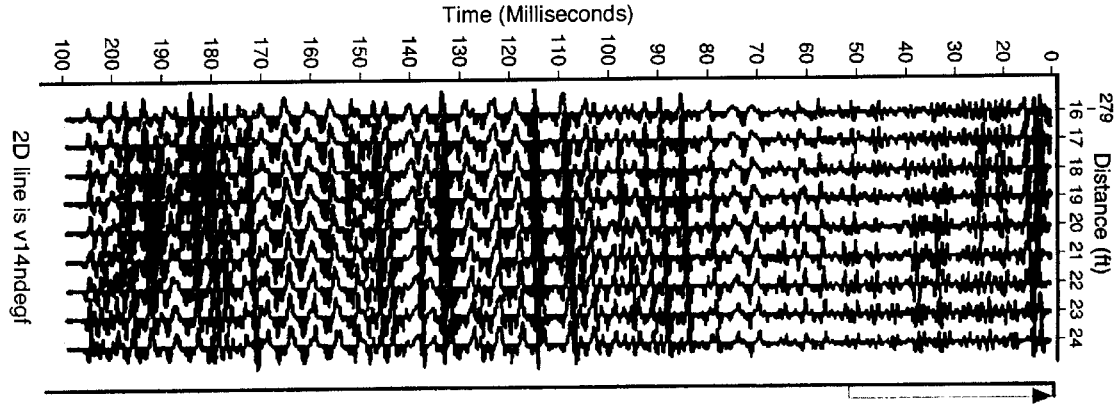
Figures 6A, 6B, 6C, 6D:
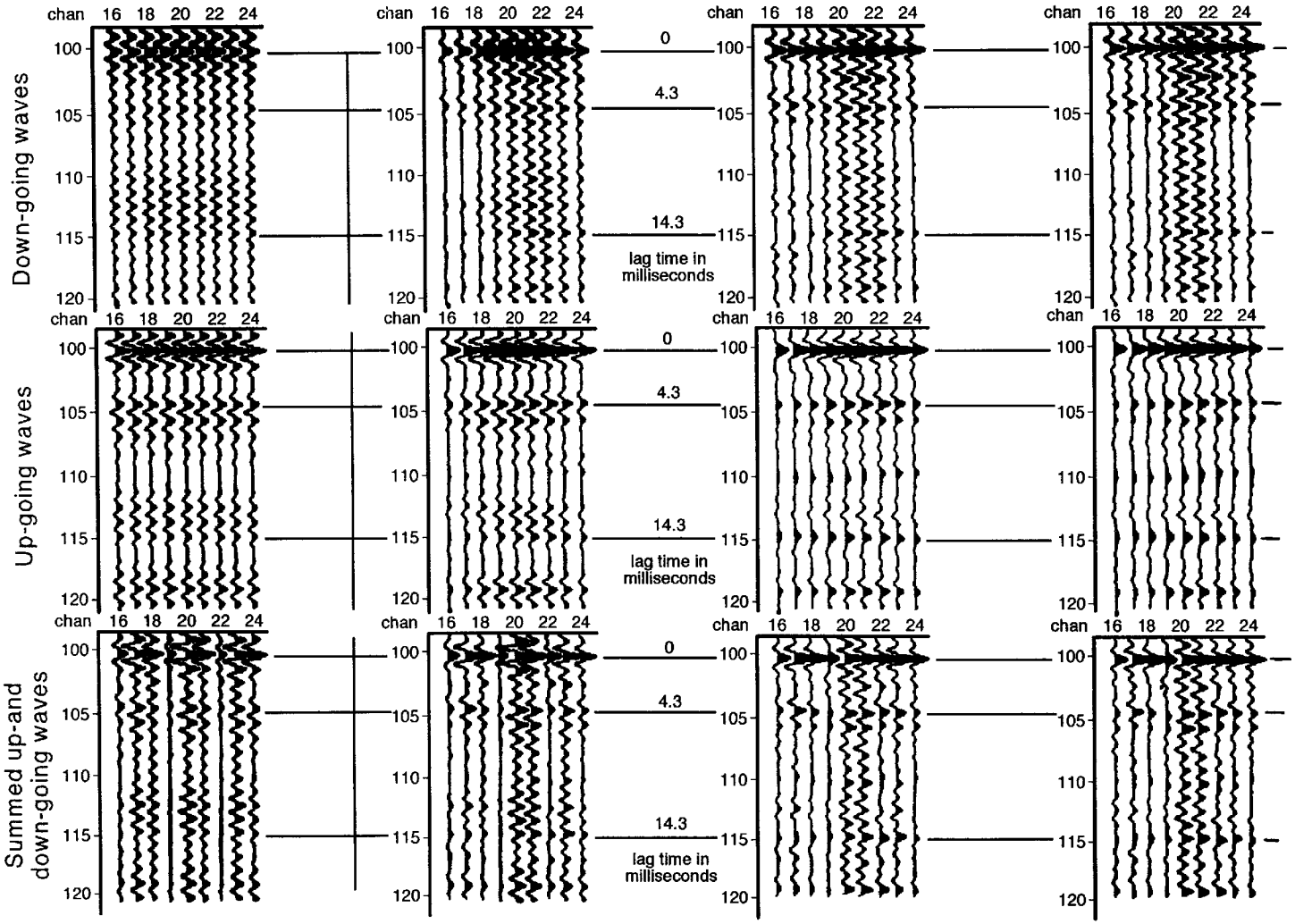
FIGS. 6A–6D show graphical illustrations of the autocorrelation function of the upwardly propagating, downwardly propagating, and summed waves.

FIGS. 4A–4C and 5A–5C, respectively, show the seismic record obtained for the transient forced vibration survey of the present invention after band-pass filtering to pass frequencies between 100 and 1300 hz, followed by velocity filtering of ±6, 10, and 14° about the measured velocity of 6800 feet per second across the geophone array 12 so as to isolate the up-going waves (shown in FIGS. 4A–4C) and the down-going waves (shown in FIGS. 5A–5C). With reference to these FIGS. 4A–4C and 5A–5C, it can be seen that there are many multiple reflected events contained in the data. The patterns are far too complex to directly interpret. However, one also can recognize that there are major periodicities in these data which are also too complex to interpret by visual inspection. However, the pile lengths can be determined, in one form of the present invention, by correcting the data for spherical spreading and dispersion so as to produce gain corrected data to approximate plane wave propagation and then by autocorrelating the corrected data. The autocorrelation function will show a peak corresponding to a periodicity related to a length of the pile.

Another approach is to autocorrelate the data with both up-going and down-going waves. It was found that dividing the record into separately up-going and down-going waves by velocity filtering before calculating the autocorrelation functions provides much simpler and interpretable patterns. The separation into up-going and down-going waves is rather straight forward. The up-going waves cross the geophone array 12 with the velocity of +6,800 feet per second. The down-going waves cross the array with −6,800 feet per second velocity. This velocity was measured from the pattern of first energy arrivals as shown in FIG. 2.

FIGS. 6A–6D show, respectively, the autocorrelation functions of the corresponding velocity filters as applied to FIGS. 4A–4C and 5A–5C. The effect of broadening the filter aperture is dramatically seen in the autocorrelation function. The narrower the aperture, the more oscillatory (narrower bandwidth) the filter output. The correlation functions all show a consistent, strong correlation peak at 4.3 msec. lag, and another slightly weaker correlation peak at 14.3 msec. This is seen on the autocorrelation functions from both up-going and down-going waves and the summed up-and down-going waves.

With reference to FIG. 3, these first two peaks should correspond to the two predicted periodicities $\Delta T_1$ and $\Delta T_2$. The periodicity in the upper cylinder 38 will correspond to the part of the bent 14 from the construction joint to the top of the pier cap. The periodicity $\Delta T_2$ of the lower cylinder 40 will correspond to the bottom 27 of the pile 20 to the construction joint.

With reference to the experimental data, since the dimension of the two parts of the structure are known to be 14.25 and 45 feet, respectively, this gives a predicted periodicity of (14.25 ft/6,800 ft/sec)×2=4.2 msec and (45 ft/6,800 ft/sec)×2=13.2 msec. These calculated lag times agree acceptably with the measured lag times of 4.3 and 14.3 msec. As a result, it can be seen that the autocorrelation function allows the identification of the major periodicities in the upper and lower cylinders and provides satisfactory accuracy so as to determine the length of pile 20.

It should be noted that geophone 22 should ideally be placed on the pile 20 below the pile cap 18 so as to achieve greater accuracy in the determination of the length of the pile 20. It may be necessary to excavate sufficiently around the pile cap 18 so as to place the geophone 22 on the upper end of the pile 20. This placement of the geophone 22 enables direct measurement of the reverberation in the pile 20 so as to verify the identification of the autocorrelation lags with the proper part of the total structure. It is expected that the above-ground dimension of the structure can be directly measured to assist in the identification of the various correlation peaks that are detected. The vertical array of geophones 12 on the exposed portion of the bent 14 also provides the data required to measure the elastic wave velocity in the structure.

Parallel Seismic Survey Profile

Figure 7:
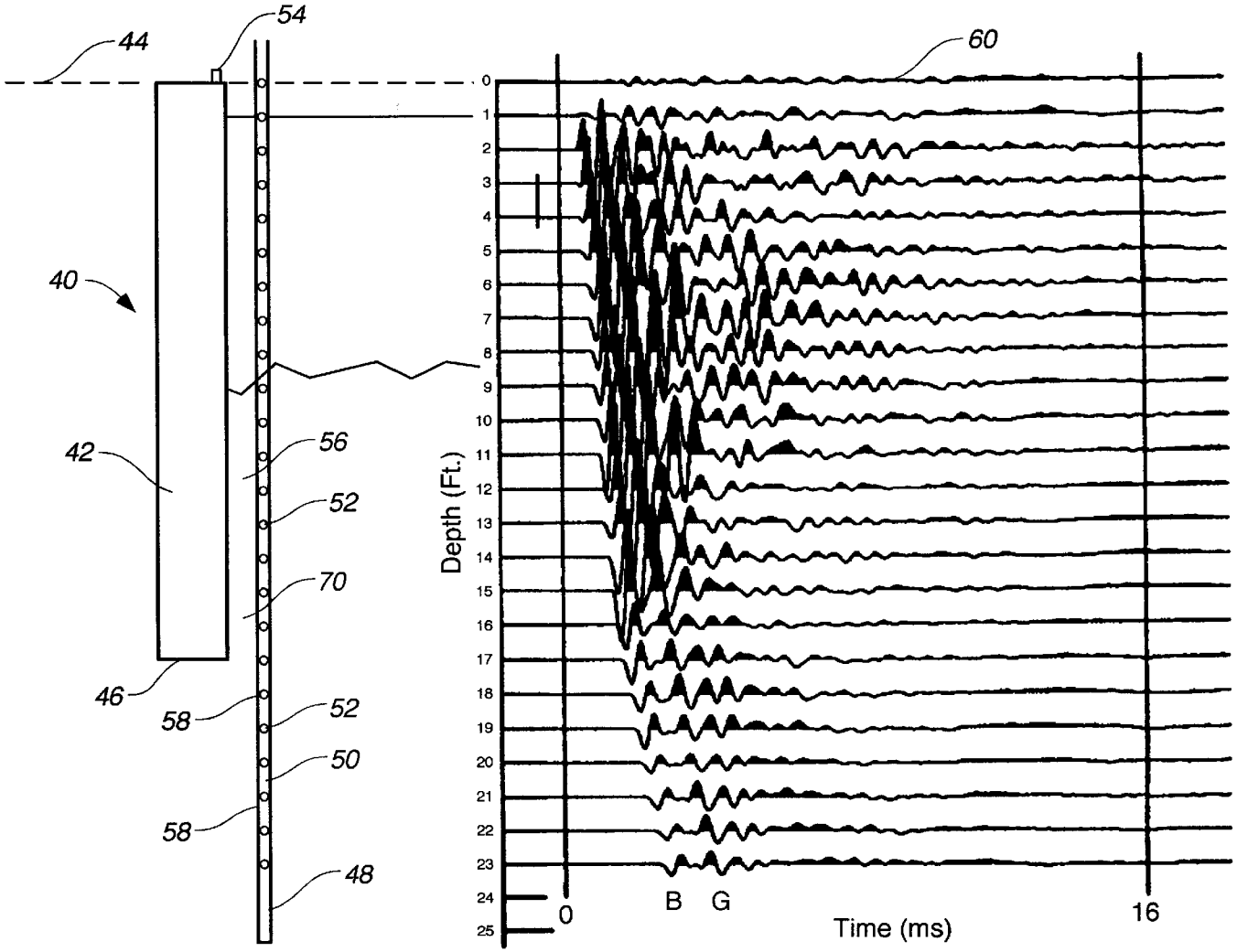
FIG. 7 is an illustration showing the configuration of the parallel seismic survey profile form of the present invention with the graphical illustration of the seismic data obtained from the vertical array of sound sensors.

FIG. 7 shows an alternative embodiment of the present invention which is a parallel seismic survey profile system 40. The system 40 serves to measure the length of shaft 42 which is fixed within the earth 44. The bottom 46 of the shaft 42 extends from the earth 44 a distance which is to be measured by the present invention. A vertical hole 48 is drilled into the earth 44 for a distance greater than the expected length of the shaft 42. A vertical array 50 of hydrophones 52 is positioned within the vertical hole 48 so as to extend in the vertical hole 48. At least one of the hydrophones 52 should extend below the bottom 46 of the shaft 42. An elastic wave generating source 54 is positioned on the surface 44 of the earth or on the pier so as to create an elastic wave that passes through the shaft 42 and will pass from the shaft 42 as refracted elastic waves. The elastic waves generated by the source 54 will pass from the bottom 46 of the shaft 42 as a diffracted elastic wave. The hydrophones 52 of the hydrophone array 50 will serve to receive the elastic wave as refracted and diffracted from the shaft 42.

System 40 serves to conduct a survey by utilizing the theoretical energy path propagating down the shaft 42 as a refracted wave. The refracted wave radiates energy into the soil 56 between the vertical hole 48 and the exterior of the shaft 42. This refracted wave is received by the vertical hydrophone array 50. Below the bottom 46 of the shaft 42, the elastic wave energy will diffract and be recorded at the hydrophones 58 below the bottom 46 of the shaft 42. The vertical array 50 serves to record the diffraction, so as to locate the bottom of the shaft 42 by subsequent analysis including migration of the data.

Figure 8:
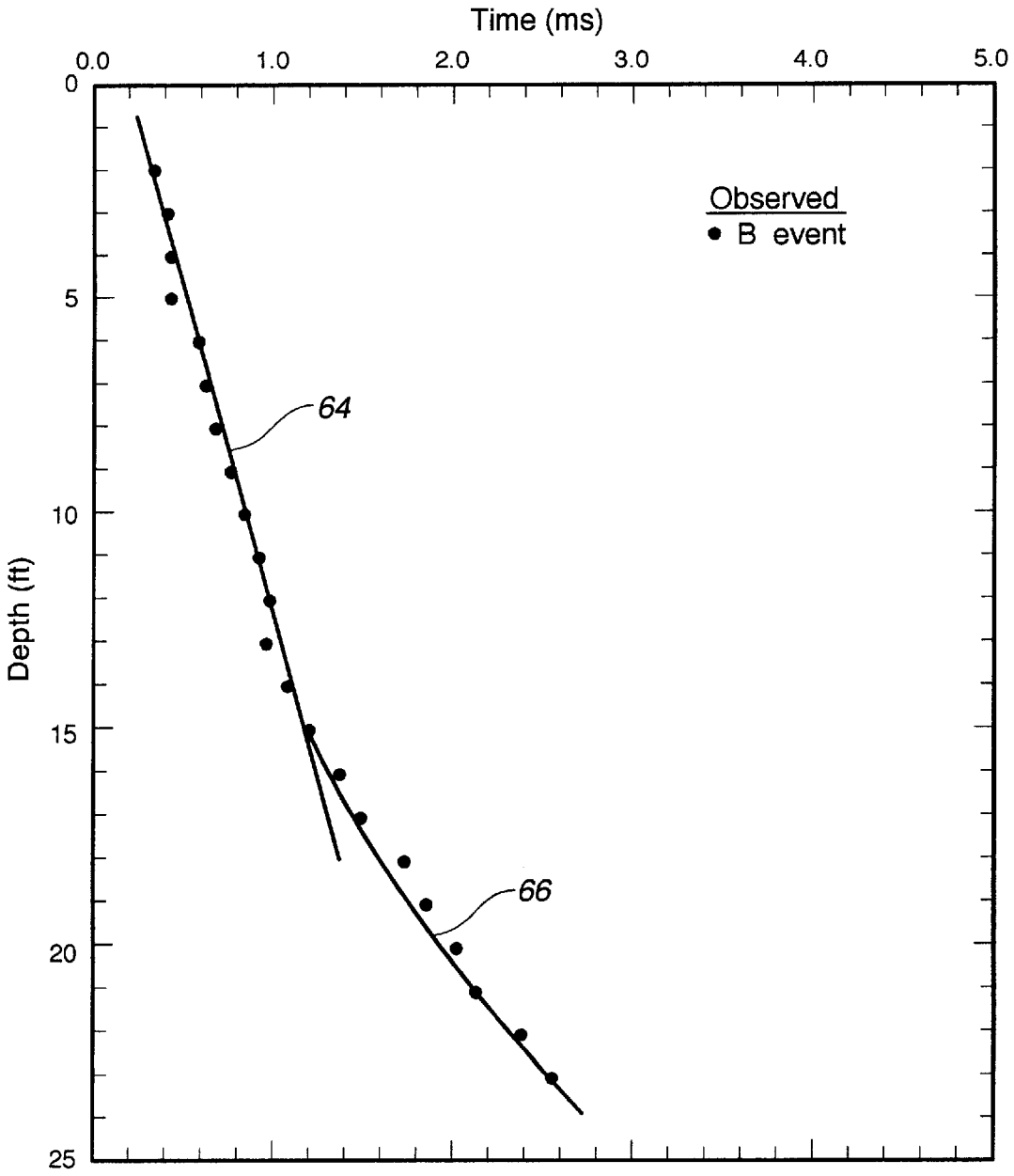
FIG. 8 is a graphical illustration of the relationship of the linear refraction arrival times relative to the curved diffraction arrival times.

As can be seen in FIG. 7, the seismic data 60 is shown as recorded by the vertical array 50. The refracted event propagates down the shaft 42 and is readily identified by the linear moveout of the first energy arrivals, which fit a P-wave velocity of 15,500 feet per second. This velocity is appropriate for concrete. P-waves are generated in this instance since the source 54 applies a blow to the top of the shaft 42. The point where the refracted wave front changes to a curved diffraction wave front can be seen by visual inspection of the seismic data 60. FIG. 8 shows graphically the plot of the first energy arrival times from the system 50 of the present invention. As can be seen, in FIG. 8, the plot of the first energy arrival times shows the change from the linear refraction arrival time pattern 64 to the curved diffraction arrival time path 66. It can be seen that this change occurs at approximately 16 feet. As such, the shaft 42 can be easily seen to have a length of approximately 16 feet. The actual length of the shaft is 17 feet.

Figure 9:
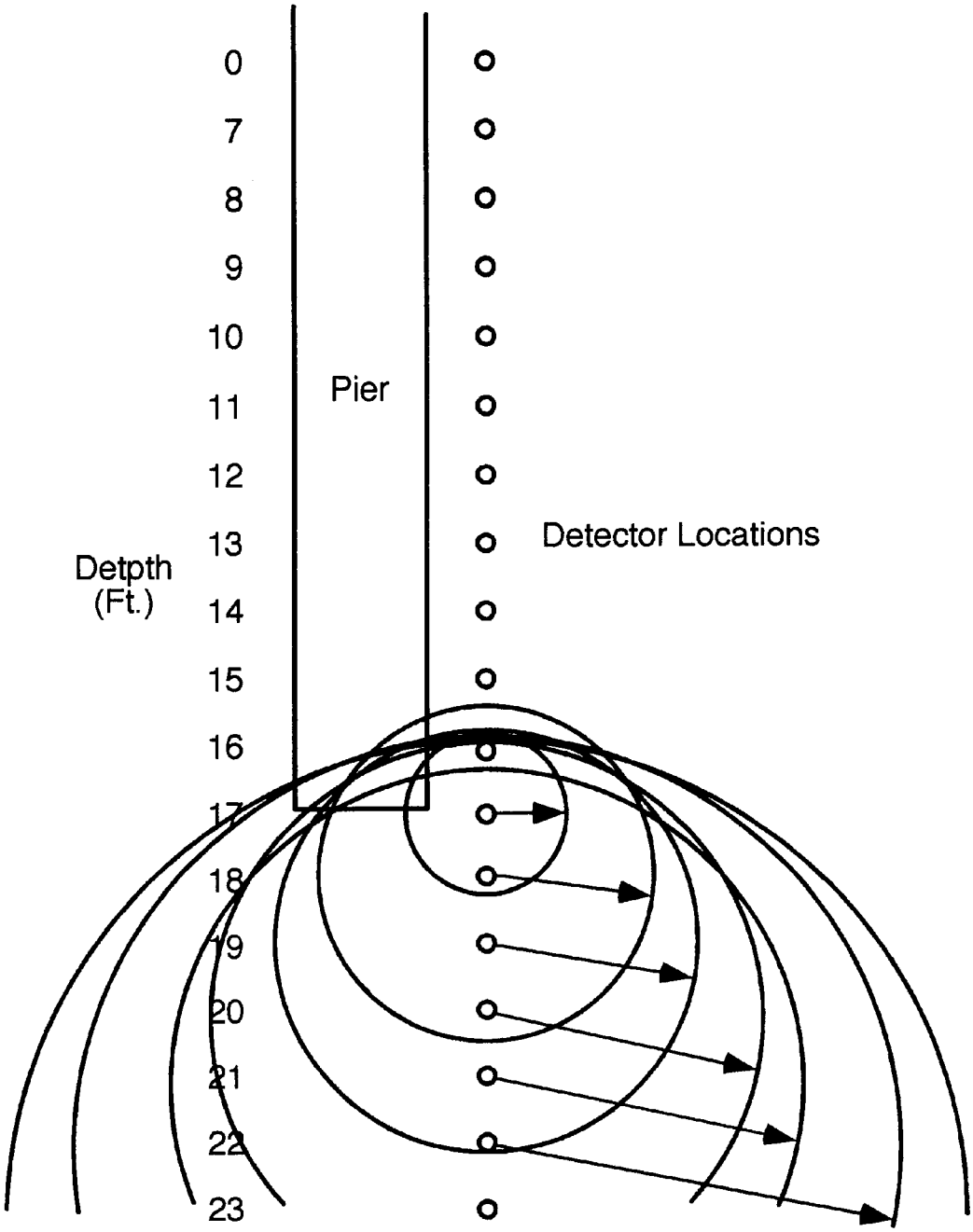
FIG. 9 is an illustration of the reconstruction of the diffraction center from the first energy arrival measurements.

FIG. 9 shows how this point can be confirmed by picking the first energy times and migrating the data. This migration is equivalent to plotting a circle of radius calculated from the velocity of propagation of the soil 56 and the departure of the first energy arrival time from the linear extrapolation of the refraction arrival times established by the data from the hydrophones 52 above the bottom 46 of the pile 42. FIG. 9 shows the circles as calculated from the measured first energy arrival times. The circles coalesce in a one foot zone at the known bottom of the shaft. As such, the diffraction center is accurately identified as 17 feet (the actual length of the pile 42).

The correct soil velocity is obtained by separately initiating the energy source 54 on the earth 44 adjacent to the vertical hole 48 and by recording the travel times from the surface 44 to the vertical array of hydrophones 52 in the vertical hole 48. The soil velocity is obtained by plotting the first energy arrival times as a function of depth, fitting a straight line through these measured times, and calculating the velocity from the slope of this line. In the experiments shown in FIGS. 7–9, the measured velocity is 5,500 feet per second.

The vertical hole 48 may be filled with a liquid, preferably water. If water is not available, it is also possible that clamped geophones can be used instead of hydrophones to form the array 50.

In the system 40, the resolution of the shaft depth to within one foot is acceptable for bridge maintenance purposes. The advantages of the system 40 are that, in contrast to the areal survey, little room is required around the bent such that access is much simpler for routine investigations. This method does require some second-guessing as to the maximum length of the shaft 42, since the test hole must extend far enough below the true bottom of the shaft 42 so as to record diffractions. Since the typical maximum drilled shaft lengths are generally well known, this is a minor problem. The cost of drilling a four inch diameter examination hole 48 adjacent to the shaft 42 is relatively minor.

The foregoing disclosure and description of the invention is illustrative and explanatory thereof. Various changes in the steps of the described method may be made within the scope of the appended claims without departing from the true spirit of the invention. The present invention should only be limited by the following claims and their legal equivalents.

I claim:

1. A method for determining a length of a pile comprising the steps of:

affixing a plurality of elastic wave sensors in a vertical array adjacent to the pile, said plurality of elastic wave sensors being responsive to elastic waves passing from the pile;

generating an elastic wave adjacent the pile such that said elastic wave propagates through or from the pile;

radiating said elastic wave from the pile such that said plurality of elastic wave sensors receive the radiated elastic wave; and analyzing the radiated elastic wave so as to determine the length of the pile.

2. The method of claim 1, said step of affixing comprising:

affixing the plurality of elastic wave sensors directly to a structure connected to and above the pile.

3. The method of claim 2, said structure being a bent positioned directly above the pile, each of said plurality of elastic wave sensors being a geophone, each of said plurality of elastic wave sensors being equally spaced from an adjacent elastic wave sensor.

4. The method of claim 1, said step of radiating comprising the steps of:

generating said elastic wave so as to create upwardly propagating waves and downwardly propagating waves within the pile.

5. The method of claim 4, said step of analyzing comprising the steps of:

correcting for spherical spreading and dispersion of the upwardly propagating waves and downwardly propagating waves so as to produce gain corrected data approximating plane wave propagation; and autocorrelating said gain corrected data so as to produce a peak corresponding to a periodicity related to a length of the pile.

6. The method of claim 4, said step of analyzing comprising the steps of:

separating the upwardly propagating waves from the downwardly propagating waves; and autocorrelating the upwardly propagating waves and the downwardly propagating waves so as to produce a peak corresponding to a periodicity related to a length of the pile.

7. The method of claim 2, said step of radiating comprising the steps of:

generating said elastic wave so as to create upwardly propagating waves and downwardly propagating waves within the structure and within the pile.

8. The method of claim 7, said step of analyzing comprising the step of:

correcting for spherical spreading and dispersion of the upwardly propagating waves and downwardly propagating waves so as to produce gain corrected data approximating plane wave propagation.

9. The method of claim 7, further comprising the steps of:

filtering the upwardly propagating waves from the downwardly propagating waves; and autocorrelating separately the upwardly propagating waves and the downwardly propagating waves so as to produce a peak corresponding to a periodicity related to a length of the structure and a peak corresponding to a periodicity related to the length of the pile.

10. The method of claim 9, further comprising the step of measuring a velocity of the generated elastic wave, said step of analyzing comprising the step of:

analyzing the periodicity related to the length of the pile relative to said velocity of said elastic wave so as to indicate an expected physical length of the pile.

11. The method of claim 2, further comprising the step of:

affixing at least one elastic wave sensor directly to the pile below said structure; and receiving the radiated elastic wave directly by said at least one elastic wave sensor.

12. The method of claim 1, said step of affixing comprising:

forming a vertical hole adjacent to and in generally parallel relationship to the pile; and placing said vertical array in said hole.

13. The method of claim 12, said vertical hole having a depth greater than the length of the pile, said vertical array having said plurality of elastic wave sensors extending so as to be lower than an expected bottom of the pile.

14. The method of claim 12, said step of generating an elastic wave comprising the step of:

generating an elastic wave source on or adjacent to a top of the pile such that said elastic wave propagates through the pile as a refracted wave.

15. The method of claim 14, said step of radiating comprising the steps of:

refracting said elastic wave along a length of the pile; and diffracting said elastic wave at a bottom of the pile.

16. The method of claim 15, said step of analyzing comprising the steps of:

determining a point along said vertical array in which the refracted elastic wave changes to the diffracted wave; and correlating said point with a length dimension along said vertical array so as to be related to the length of the pile.

17. The method of claim 16, said step of determining comprising the steps of:

picking a first energy arrival time of said elastic wave to said point; and migrating a velocity of propagation of the elastic wave through soil between said vertical hole and the pile so as to establish a diffraction center.

18. The method of claim 17, further comprising the steps of:

measuring the velocity of propagation of the elastic wave by generating the elastic wave on the soil adjacent said vertical hole and recording travel times from a surface of the soil to said vertical array;

plotting a first energy arrival time from the surface as a function of depth;

fitting a straight line through the recorded travel time; and calculating a velocity from a slope of the fitted straight line.

19. The method of claim 12, each of said plurality of elastic wave sensors being a hydrophone or a clamped geophone.

20. The method of claim 19, further comprising the step of:

filling at least a portion of the vertical hole with a liquid.

* * * * *